US012729530B2

(12) United States Patent
Kolisnek

(10) Patent No.: US 12,729,530 B2
(45) Date of Patent: Sep. 8, 2026

(54) PORTABLE PROTECTIVE ENCLOSURE

(71) Applicant: Kurtis Kolisnek, Airdrie (CA)

(72) Inventor: Kurtis Kolisnek, Airdrie (CA)

( * ) Notice: Subject to any disclaimer, the term of this patent is extended or adjusted under 35 U.S.C. 154(b) by 337 days.

(21) Appl. No.: 18/519,127

(22) Filed: Nov. 27, 2023

(65) Prior Publication Data

US 2025/0171997 A1 May 29, 2025

(51) Int. Cl.
*E04B 1/343* (2006.01)
*E04H 1/12* (2006.01)

(52) U.S. Cl.
CPC ..... *E04B 1/34321* (2013.01); *E04B 1/34352* (2013.01); *E04H 1/1205* (2013.01)

(58) Field of Classification Search
CPC .... E04B 1/34321; E04B 1/34352; E04B 1/14; E04B 1/344; E04B 2/58; E04B 2/292; E04B 2/296; E04B 2/30; E04B 2103/04; E04B 2103/06; E04H 1/1205; E04H 2001/1283; E04C 2002/004; E06B 7/32; A01K 1/0017; A01K 1/032; A01K 1/033; A01K 1/034; A01K 31/10; A01K 1/0035
USPC ..... 52/79.1
See application file for complete search history.

(56) References Cited

U.S. PATENT DOCUMENTS 1,206,501 A * 11/1916 Bell et al. ..... B32B 7/06 428/189
1,433,777 A 10/1922 Robertson
2,930,353 A * 3/1960 Sievers ..... A01K 1/0017 49/63
3,023,463 A 3/1962 Bigelow, Jr.
3,675,379 A * 7/1972 Lambert ..... E04H 1/1238 52/274
3,886,699 A * 6/1975 Bergmann, Jr. ..... E04C 2/205 52/91.1
3,968,602 A * 7/1976 Mitchell ..... E04G 21/28 182/47
3,991,717 A * 11/1976 Buchanan ..... A01K 1/034 119/458
4,120,376 A 10/1978 Palmer
(Continued)

FOREIGN PATENT DOCUMENTS

BE 842848 A * 10/1976 ..... E04H 1/12
CN 202577581 U * 12/2012 ..... B63B 29/025
(Continued)

*Primary Examiner* — Brian D Mattei
*Assistant Examiner* — Joseph J. Sadlon
(74) *Attorney, Agent, or Firm* — Lewellyn Law, PLLC; Stephen Lewellyn

(57) ABSTRACT

A portable protective enclosure for equipment located outside, such as, for example pumps, it preassembled and towable to an in-service position for enclosing the equipment and protecting it from cold weather environments. The enclosure has first and second skids being arranged parallel and spaced to one another defining a space therebetween, the first and second skids having a first end and an opposite second end. The enclosure may further have a building supported on the skids for movement therewith, the building comprising first and second end walls each extending across the skids, first and second side walls one each extending along a length of a respective skid, and a roof spanning the first and second end walls and the first and second side walls, the building being free of a floor.

16 Claims, 10 Drawing Sheets

(56) References Cited

U.S. PATENT DOCUMENTS 4,202,146 A * 5/1980 Adams ..... E04B 1/34336 52/143
4,214,412 A * 7/1980 Barylski ..... B60P 3/32 52/169.12
4,219,982 A * 9/1980 Hart ..... E04B 1/3447 52/645
D266,235 S * 9/1982 Hughes ..... D12/101
4,438,606 A 3/1984 Andre-Marie et al.
4,485,608 A * 12/1984 Kaufman ..... E04B 1/10 156/92
4,616,459 A * 10/1986 Shubow ..... E04B 1/20 52/741.15
4,637,299 A * 1/1987 Harding ..... E04H 1/1216 454/276
4,689,924 A * 9/1987 Jurgensen ..... E04B 1/3444 52/67
4,748,790 A * 6/1988 Frangolacci ..... H05K 9/0001 428/116
4,788,934 A * 12/1988 Fetter ..... A01K 1/0353 D30/114
4,800,701 A * 1/1989 Dunsworth ..... E04H 6/005 52/143
4,829,701 A * 5/1989 ImBrogno ..... A01K 31/10 43/67
4,918,765 A * 4/1990 Harding ..... A47K 11/02 52/282.4
4,964,899 A * 10/1990 Griffis ..... A62B 31/00 454/158
5,203,707 A * 4/1993 Musto ..... A62C 99/0081 434/226
5,256,105 A * 10/1993 Austin ..... F24F 3/167 454/220
5,285,604 A * 2/1994 Carlin ..... E04H 1/1205 52/36.2
5,353,557 A * 10/1994 Lerner ..... E04H 3/08 52/106
5,417,539 A * 5/1995 van der Wal ..... B60P 3/00 280/483
5,446,580 A * 8/1995 Collins ..... E04H 15/003 135/117
5,537,784 A * 7/1996 Baldwin ..... E21F 11/00 52/63
5,622,198 A * 4/1997 Elsinger ..... E04B 1/345 135/128
5,657,583 A * 8/1997 Tennant ..... E04B 1/34321 52/270
5,752,470 A * 5/1998 Koneke ..... A01K 1/0125 119/499
5,826,389 A * 10/1998 Siler ..... E04B 1/28 52/262
5,848,500 A * 12/1998 Kirk ..... E04B 1/5831 403/231
6,053,190 A * 4/2000 Brown, Jr. ..... A01M 31/02 135/901
6,058,660 A * 5/2000 Melton ..... E04H 6/04 52/36.5
6,176,046 B1 * 1/2001 Quine ..... F17D 1/04 48/190
6,343,443 B1 * 2/2002 Tylicki, Jr. ..... E04B 1/34336 52/432
6,349,510 B1 2/2002 Robert et al.
6,393,769 B1 * 5/2002 Mertik ..... E04H 3/28 296/26.14
6,408,796 B1 * 6/2002 Hampel ..... A01K 1/0035 119/482
6,561,215 B1 5/2003 Marty
6,598,363 B1 * 7/2003 Ferguson ..... E04B 1/34315 52/270
6,920,721 B2 * 7/2005 Johns ..... E04B 1/34336 280/789
6,981,347 B1 * 1/2006 Walburger ..... E04H 3/02 52/36.2
7,021,010 B2 * 4/2006 Smith ..... E04B 1/34331 296/210
7,076,922 B1 * 7/2006 Parres ..... E04B 1/8218 52/79.5
7,111,633 B2 * 9/2006 Moroney ..... E04H 15/28 135/132
7,191,788 B2 * 3/2007 Holub ..... E04H 15/32 135/117
7,316,749 B2 * 1/2008 Smith ..... E04B 1/34321 52/762
7,455,069 B2 * 11/2008 Sumner ..... E04H 15/32 135/117
7,500,335 B1 * 3/2009 Kjose ..... E04H 3/28 52/79.5
7,608,934 B1 * 10/2009 Hunter ..... F02D 25/00 290/4 R
7,793,466 B2 * 9/2010 de Cherance ..... E02D 27/36 52/114
7,823,338 B2 * 11/2010 Slagel ..... E04H 1/1205 52/33
7,828,329 B2 * 11/2010 Biscan ..... B62D 21/20 280/789
7,937,895 B2 * 5/2011 Janka ..... F24F 13/20 52/270
8,074,403 B1 * 12/2011 Mentnech ..... E04B 1/343 52/79.5
8,640,409 B2 * 2/2014 Thomson ..... E04B 5/43 52/251
8,661,749 B2 * 3/2014 Gibson ..... E04H 4/144 52/182
8,683,753 B2 * 4/2014 Bachorz ..... E04B 5/29 52/79.5
8,925,255 B1 * 1/2015 Haun ..... E04F 11/022 52/91.1
8,997,767 B2 * 4/2015 Hotes ..... E04H 15/322 52/63
9,157,249 B2 * 10/2015 Segall ..... E04B 1/34321
9,212,499 B1 * 12/2015 Maurer ..... E04H 5/02
9,222,250 B2 * 12/2015 Peterson ..... E04B 1/3447
9,267,304 B2 2/2016 Elworthy
9,290,947 B2 * 3/2016 Meier ..... E04F 11/022
9,416,528 B2 * 8/2016 Schaffert ..... E04B 1/3445
9,702,160 B2 * 7/2017 Wirtz ..... E04B 1/34321
9,776,223 B2 * 10/2017 Rankin ..... E04H 15/14
9,915,062 B2 * 3/2018 Forsland ..... E04B 1/34305
9,970,207 B2 * 5/2018 Wasson ..... E04H 15/20
10,017,399 B2 * 7/2018 Kamen ..... B01D 1/0035
10,167,624 B1 * 1/2019 Hodgetts ..... E04B 1/34384
10,206,501 B1 * 2/2019 Kindred, Jr. ..... A47B 43/04
10,240,339 B1 * 3/2019 Dominguez ..... E04B 1/34869
10,340,697 B2 * 7/2019 Paine ..... F01N 3/2066
10,370,847 B2 * 8/2019 Caffaratti Giro ..... E04B 1/8218
10,407,989 B2 9/2019 Morrell et al.
10,428,541 B2 * 10/2019 Harve ..... E04B 1/34321
10,549,675 B2 * 2/2020 Devine ..... E04H 1/02
10,597,870 B2 * 3/2020 Hedgcock ..... E04B 2/723
10,745,930 B2 * 8/2020 Newman ..... E04B 1/34352
10,781,627 B2 9/2020 Martens
10,822,821 B2 * 11/2020 Kelly ..... E04G 21/28
10,932,566 B1 * 3/2021 Waddey, Jr. ..... A47B 91/02
10,968,636 B2 * 4/2021 Charles ..... E04F 11/022
11,028,542 B2 6/2021 Rami
11,066,825 B2 * 7/2021 Kleisinger ..... E04B 1/342
11,384,529 B2 * 7/2022 Johnson ..... B65D 88/005
11,517,010 B1 12/2022 Jacob
11,623,830 B1 * 4/2023 Hall ..... E04B 1/35 414/495
11,821,206 B2 * 11/2023 Leahy ..... E04C 2/3405
12,312,823 B2 * 5/2025 Girard ..... E04H 15/06
12,366,085 B2 * 7/2025 Hanley ..... A63H 33/008
2003/0168017 A1 * 9/2003 Perelli ..... A01K 1/0107 119/165
2004/0074529 A1 * 4/2004 Levy ..... E04H 15/14 135/93
2004/0154235 A1 * 8/2004 Johnson ..... E04B 1/34321 52/79.5

(56) References Cited

U.S. PATENT DOCUMENTS

2005/0055893 A1* 3/2005 Goodwin ..... E04H 15/32 52/79.1
2005/0235581 A1* 10/2005 Cohen ..... E04B 1/35 52/79.1
2006/0048459 A1 3/2006 Moore
2007/0068094 A1 3/2007 Fralish
2009/0032530 A1* 2/2009 Chu ..... B65D 88/528 220/4.28
2010/0071995 A1* 3/2010 Campbell, Jr. ..... E06C 1/34 182/115
2010/0126545 A1* 5/2010 Bullivant ..... E04H 15/36 135/125
2010/0264390 A1* 10/2010 Cerda ..... E04G 5/142 29/428
2011/0289861 A1* 12/2011 Ammons ..... E04H 5/02 52/79.12
2012/0073215 A1* 3/2012 Zhang ..... F02C 7/24 52/79.9
2013/0042541 A1* 2/2013 Forsland ..... E04B 1/19 52/66
2014/0311052 A1* 10/2014 Farmer ..... E04B 1/3442 52/79.5
2015/0034295 A1 2/2015 Osborne
2016/0097011 A1 4/2016 Murray, Sr. et al.
2016/0160515 A1* 6/2016 Wallance ..... E04F 10/10 52/745.02
2017/0189736 A1* 7/2017 Martin ..... E04H 12/22
2017/0211268 A1* 7/2017 Eichhorn ..... E04B 2/74
2017/0284084 A1* 10/2017 Carapinha ..... E04B 1/8409
2019/0292770 A1* 9/2019 Gordon ..... E04B 1/34384
2020/0352141 A1* 11/2020 Colten ..... A01K 31/16
2022/0228424 A1* 7/2022 Martens ..... E06B 3/325
2023/0294607 A1* 9/2023 Mason ..... B60R 3/007 52/182
2023/0417046 A1* 12/2023 Collins ..... E04B 9/008
2024/0334895 A1* 10/2024 Mohr ..... A01K 1/0064
2025/0376294 A1* 12/2025 Venczel ..... B65D 11/1833

FOREIGN PATENT DOCUMENTS

GB 2092640 A * 8/1982 ..... E04B 1/3483
GB 2434598 A * 8/2007 ..... E04H 1/1205
WO WO-2012075561 A1 * 6/2012 ..... E04B 1/34336

* cited by examiner

PORTABLE PROTECTIVE ENCLOSURE

TECHNICAL FIELD

The present disclosure relates generally to protective enclosures for protecting outdoor equipment and, more particularly, to portable protective enclosures for protecting outdoor equipment.

BACKGROUND

Equipment located outside is exposed to the weather which can cause damage to the equipment. While shelters exist for housing and protecting outdoor equipment from weather conditions, a need and a desire for an improved equipment shelter that is readable portable, can be installed over existing equipment, and can protect the equipment from cold weather remains.

SUMMARY

The present disclosure provides a portable protective enclosure for outdoor equipment that overcomes the disadvantages in protective enclosures now existing.

It is an object of embodiments of the invention to provide a protective enclosure for equipment that is easily portable by towing and is used to provide an insulated and heatable enclosure for protecting equipment from cold weather.

In embodiments, a portable protective enclosure comprising is provided. The enclosure may have first and second skids being arranged parallel and spaced to one another defining a space therebetween, the first and second skids having a first end and an opposite second end. The enclosure may further have a building supported on the skids for movement therewith, the building comprising first and second end walls each extending across the skids, first and second side walls one each extending along a length of a respective skid, and a roof spanning the first and second end walls and the first and second side walls, the building being free of a floor.

In embodiments, the enclosure may have the first end wall comprising a pair of first swing doors that are openable to permit access to an interior of the building and to the space between the first and second skids; and the second end wall comprising a pair of second swing doors that are openable to permit access to an interior of the building and to the space between the first and second skids.

In embodiments, the enclosure may have each swing door of the pair of first swing doors has a forward access panel located at a bottom of the door and extending along a width of the door, wherein the forward access panel is insulated panel or is a strip of flexible rubber material; and each swing door of the pair of second swing doors having two side-by-side rearward access panels located at a bottom of the door and extending along a width of the door, wherein the rearward access panels are insulated panels or a strip of flexible rubber material.

In embodiments, the enclosure may have a tow beam extending between the first and second skids at the first ends thereof, the two beam being removably attached at its opposite ends to the first and second skids; and two tow eyes attached to the tow beam and configured to be connected to a tow vehicle for towing the skids and attached building.

In embodiments, the enclosure may have a first cross member pivotally attached at one end to the first skid for rotation within the space between the first and second skids between a first position wherein the first cross member extends between the skids and a second position wherein the first cross member extends along a length of the first skid, the opposite end of the first cross member being detachably secured to the second skid when in the first position.

In embodiments, the enclosure may have a second cross member pivotally attached at one end to the second skid for rotation within the space between the first and second skids between a first position wherein the second cross member extends between the skids and a second position wherein the second cross member extends along a length of the second skid, the opposite end of the second cross member being detachably secured to the first skid when in the first position.

In embodiments, the enclosure may have the first side wall having a pair of first side access panels disposed at a bottom end of the first side wall approximate the second end wall, wherein the first side access panels are insulated panels or a strip of flexible rubber material; and the second side wall having a pair of second side access panels disposed at a bottom end of the second side wall approximate the second end wall, wherein the first side access panels are insulated panels or a strip of flexible rubber material.

In embodiments, the enclosure may have one or more doors in one or both of the first and second side walls. In embodiments, the enclosure may also have one or more steps attached to one or both of the first and second side walls.

Numerous additional objects, features, and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

For a better understanding of the invention, its operating advantages, and the specific objects attained by its uses, reference should be had to the accompanying drawings and descriptive matter in which there are illustrated embodiments of the invention.

DETAILED DESCRIPTION

Figure 1:
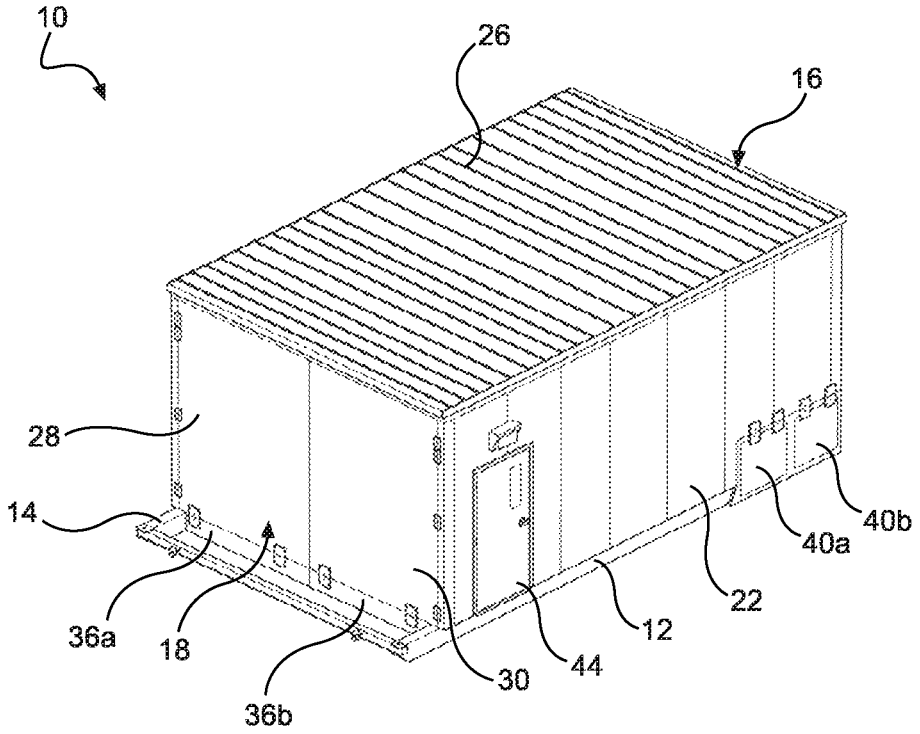
FIG. 1 is a perspective view of a portable protective enclosure according to an embodiment of the invention.
Figure 2:
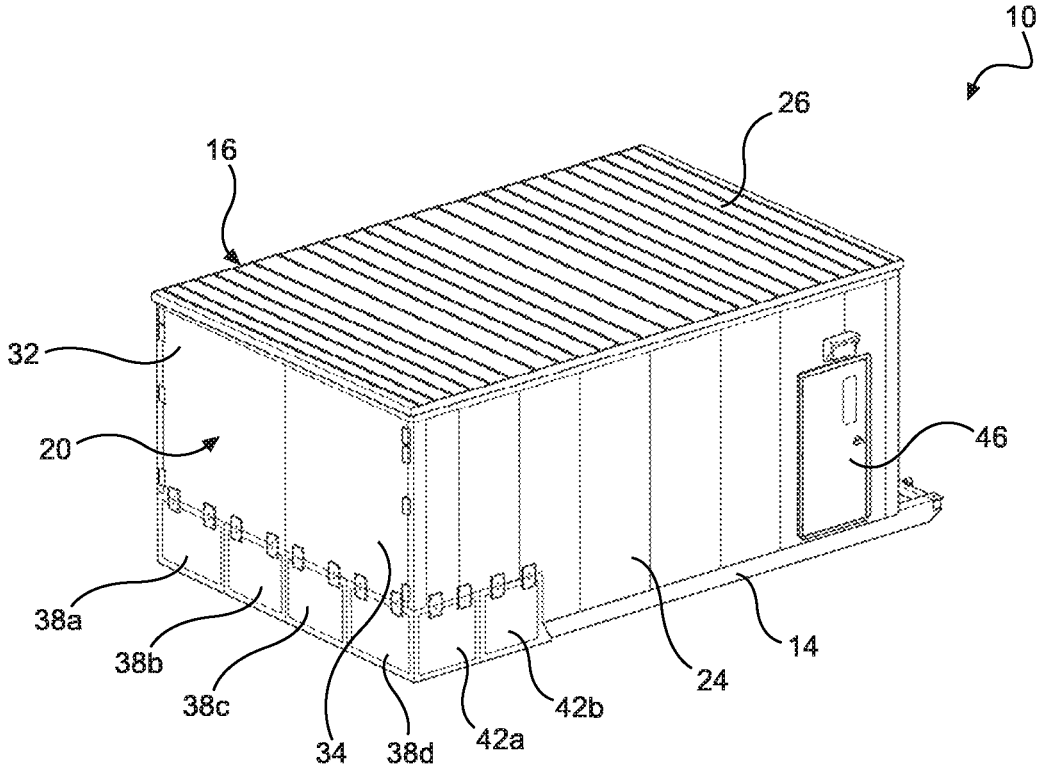
FIG. 2 is a second perspective view of the portable protective enclosure according to an embodiment of the invention.
Figure 3:
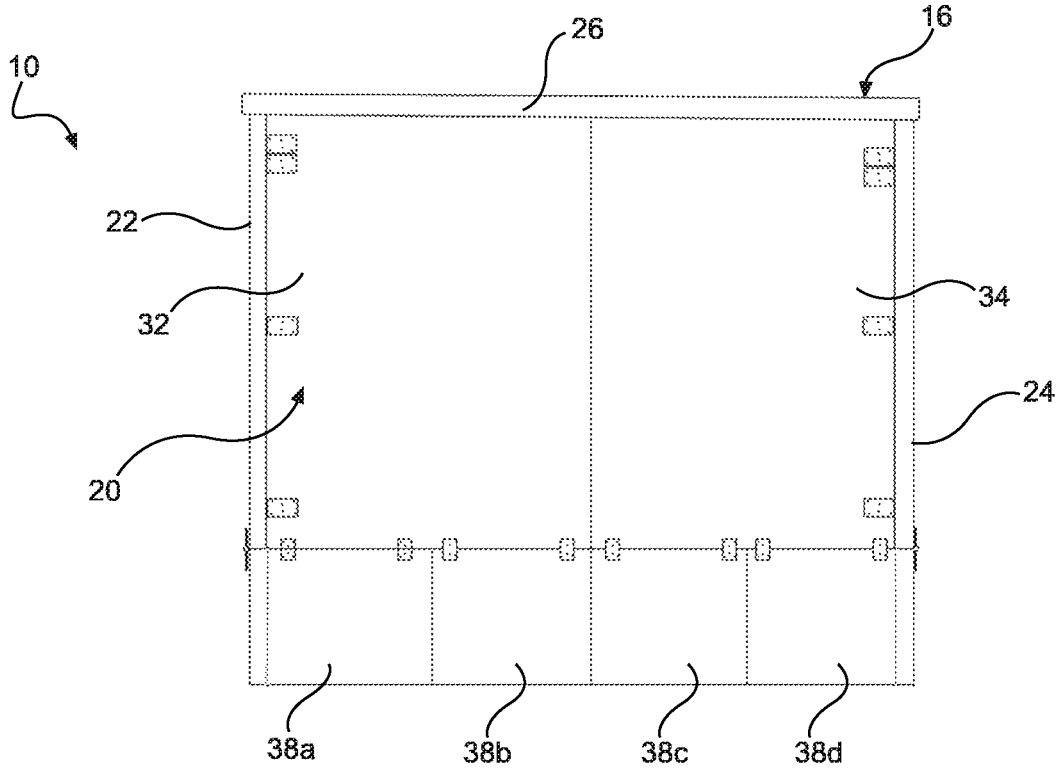
FIG. 3 is an elevation view of an end of the portable protective enclosure according to an embodiment of the invention.
Figure 4:
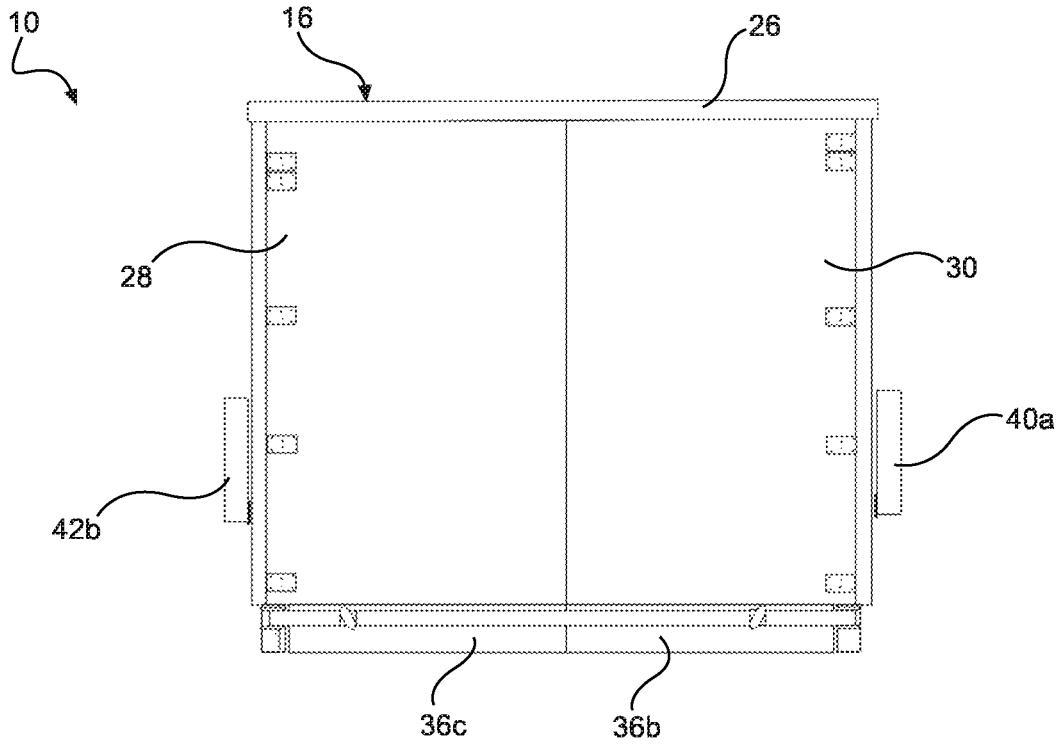
FIG. 4 is an elevation view of a second end of the portable protective enclosure according to an embodiment of the invention.
Figure 5:
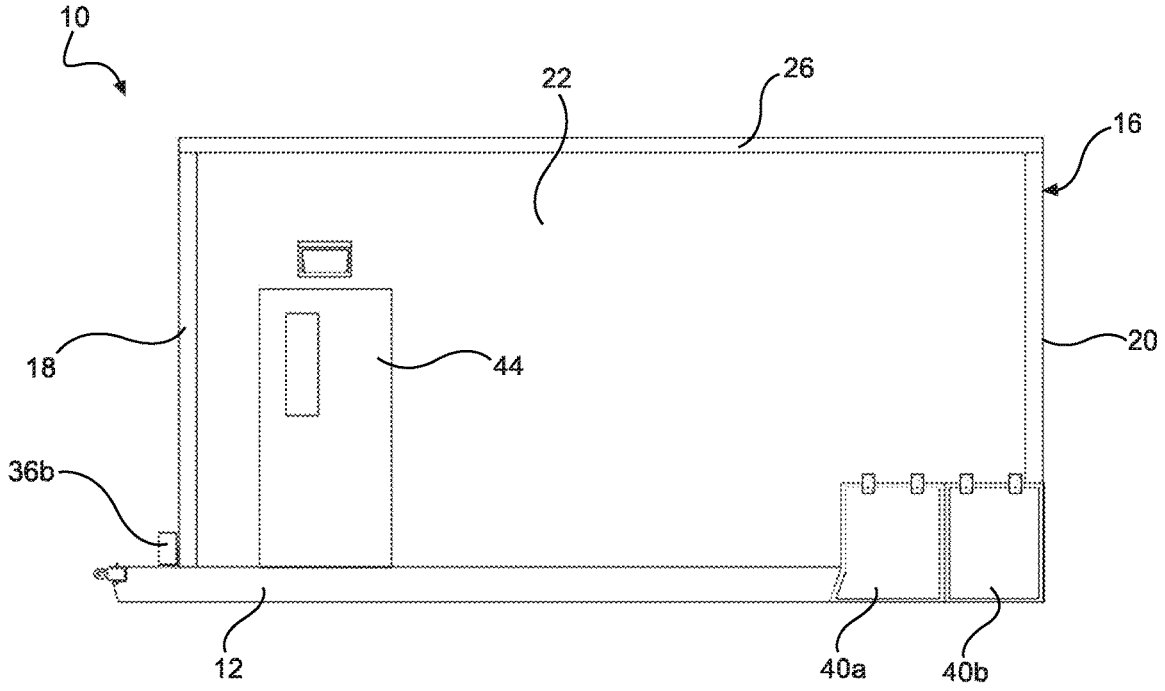
FIG. 5 is an elevation view of a side of the portable protective enclosure according to an embodiment of the invention.
Figure 6:
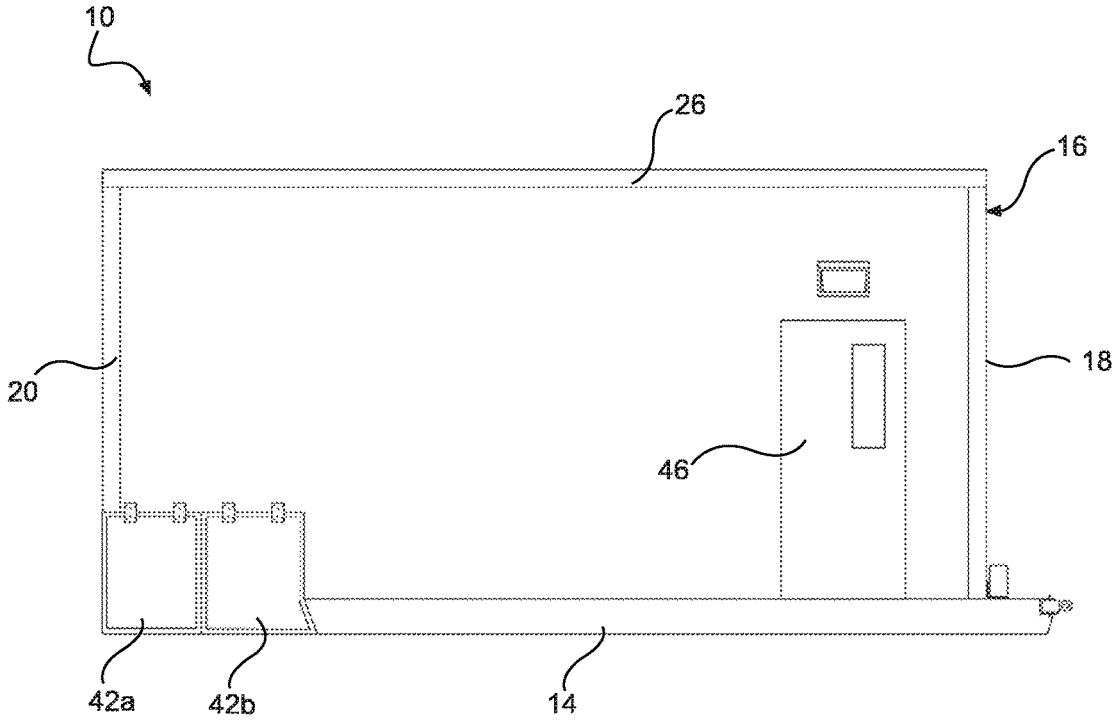
FIG. 6 is an elevation view of a second side of the portable protective enclosure o according to an embodiment of the invention.

This description and the accompanying drawings that illustrate inventive aspects, embodiments, implementations, or applications should not be taken as limiting—the claims define the protected invention. Various mechanical, structural, and operational changes may be made without departing from the spirit and scope of this description and the claims. In some instances, well-known devices, structures, or techniques have not been shown or described in detail in order not to obscure the invention. Like reference numbers in two or more figures represent the same or similar elements.

Although this description is made to be sufficiently clear, concise, and exact, scrupulous, and exhaustive linguistic precision is not always possible or desirable, since the description should be kept to a reasonable length and skilled readers will understand background and associated technology.

In addition, the singular forms "a", "an", and "the" are intended to include the plural forms as well, unless the context indicates otherwise. And the terms "comprises", "includes", "has", and the like specify the presence of stated features, steps, operations, elements, and/or components but do not preclude the presence or addition of one or more other features, steps, operations, elements, components, and/or groups.

With reference to FIGS. 1-6, an embodiment of a portable protective enclosure 10 is shown and will be described. Enclosure 10 is configured to house equipment located outside and protect the equipment from weather conditions, such as, for example, cold weather conditions.

Enclosure 10 has a pair of elongated, spaced, and parallel rigid beams providing skids 12 and 14 that are configured to be towed across a ground surface. Enclosure 10 further has a building structure 16 that is attached to and supported on the skids 12 and 14 for, among other aspects, to be towed to a location for use, as will be further described herein.

Building 16 has a pair of end walls 18 and 20, a pair of side walls 22 and 24, and a roof 26 that spans the walls to form an enclosed, protective space therebetween. End walls 18 and 20 extend across the skids 12 and 14, and side walls 22 and 24 each extend along a length of a respective skid. End wall 18 is located near a first end of skids 12 and 14 with a length of each skid extending beyond the wall. As further shown, side walls 22 and 24 extend beyond the opposite ends of the skids 12 and 14. As it will become apparent, the purpose for this configuration is to allow space along the building for equipment components, such as, for example suction and discharge lines of a pump without requiring disconnecting these lines for placement of the enclosure about the pump.

Importantly, building 16 does not have a floor which allows enclosure 10 to be positioned over equipment by moving the enclosure on its skids, as further explained below. Preferably, the walls and roof are insulated to provide heat insulation to the building. This is ideal when enclosure 10 is used to protect equipment in cold weather environments. While not shown, enclosure 10 can be provided with heaters to heat the interior space of building 16.

In aspects, end wall 18 may be comprised of a pair of swing doors 28 and 30 and end wall 20 may also be comprised of a pair of swing doors 32 and 34. These doors may be opened from the shown closed position to allow positioning enclosure 10 about equipment.

In aspects, swing doors 28 and 30 may have access panels, representatively shown as two access panels **36*a* and 36*b* arranged side-by-side along the bottoms of the doors. These access panels may be hingedly attached to the swing doors and can be rotated between a down position where the panels extend downwardly from the doors and a flipped-up position where the panels lay generally against the doors. When in the down position, panels 36*a* and 36*b* fill a gap between the bottoms of doors 28 and 30 and the ground. When in the raised position, the panels are positioned to not interfere with the opening and closing of the doors 28 and 30 against the skids 12 and 14. In aspects, these access panels 36*a* and 36*b*** can be insulated, rigid panels.

In aspects, swing doors 32 and 34 may have access panels, representatively shown as four access panels **38*a*-38*d* arranged side-by-side along the bottoms of the doors. These access panels may be hingedly attached to the doors and can be rotated between a down position where the panels extend downwardly from the doors and a flipped-up position where the panels lay generally against the doors. When in the down position, panels 38*a*-38*d* fill a gap between the bottoms of doors 32 and 34 and the ground. When in the raised position, the panels provide for an opening for equipment components to pass into and/or out of the interior space of building 16. In aspects, these access panels 38*a*-38*d*** can be insulated, rigid panels.

In aspects, side wall 22 may have access panels, representatively shown as two access panels 40*a*-40*b* arranged side-by-side along the bottom of the wall and approximate end wall 18. These access panels may be hingedly attached to the side wall and can be rotated between a down position where the panels extend downwardly from the wall and a flipped-up position where the panels lay generally against the wall. When in the down position, panels 40*a*-40*b* fill a gap between the bottom of wall and the ground. When in the raised position, the panels provide for an opening for equipment components to pass into and/or out of the interior space of building 16. In aspects, these access panels 40*a*-40*b* can be insulated, rigid panels.

In aspects, side wall 24 may have access panels, representatively shown as two access panels 42*a*-42*b* arranged side-by-side along the bottom of the wall and approximate end wall 18. These access panels may be hingedly attached to the side wall and can be rotated between a down position where the panels extend downwardly from the wall and a flipped-up position where the panels lay generally against the wall. When in the down position, panels 42*a*-42*b* fill a gap between the bottom of wall and the ground. When in the raised position, the panels provide for an opening for equipment components to pass into and/or out of the interior space of building 16. In aspects, these access panels 42*a*-42*b* can be insulated, rigid panels.

As shown, access panels 42*a*-42*b*, access panels 38*a*-38*d*, and access panels 40*a*-42*b* are arranged side-by-side, wrapping around end wall 18. In this manner, these access panels can be opened to accommodate different equipment configurations to allow equipment components, such as fluid lines, for example, to pass into and/or out of the interior of building 16.

Figure 10:
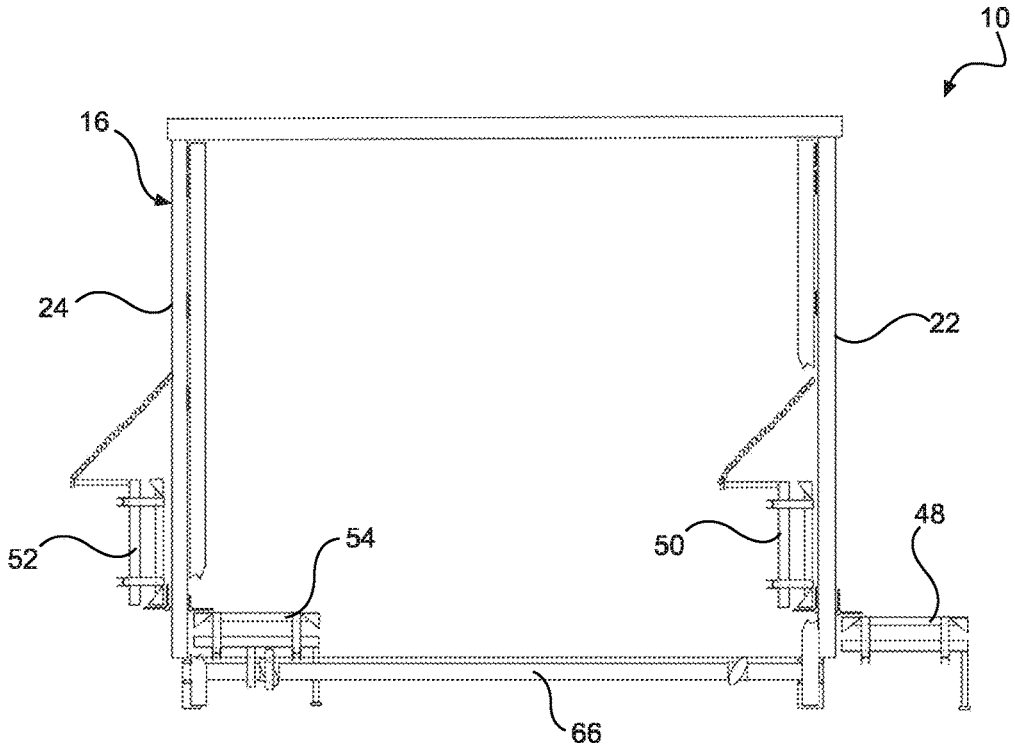
FIG. 10 is an end elevational view of a portable protective enclosure according to an embodiment of the invention.
Figure 11:
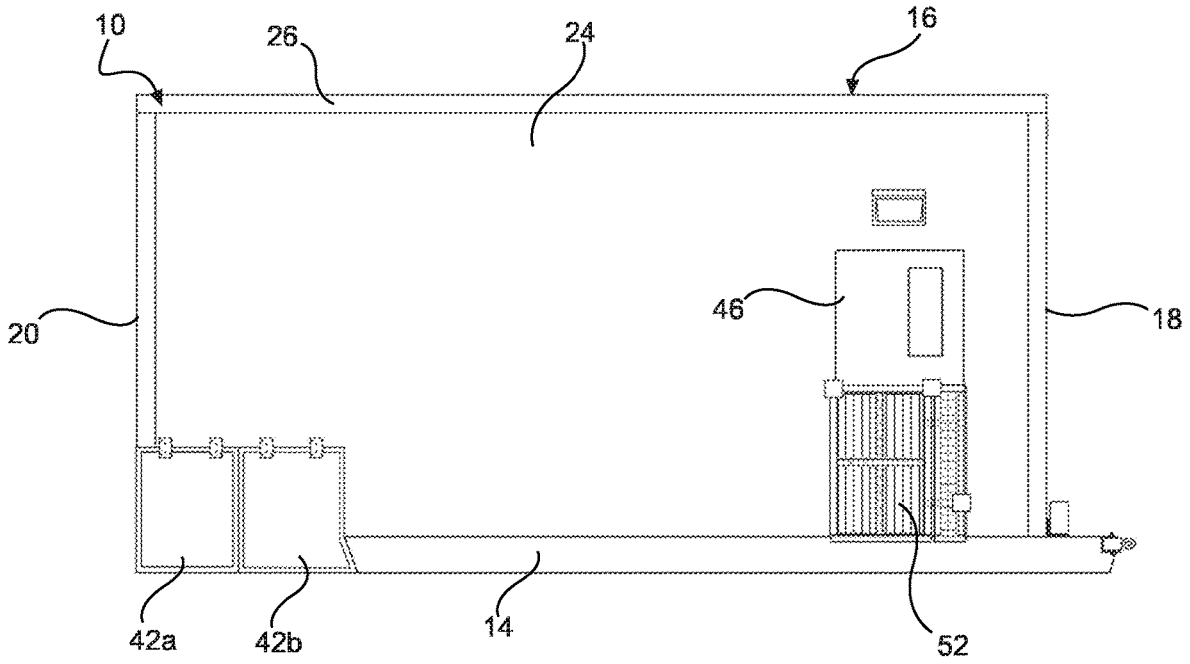
FIG. 11 is a side elevational view of a portable protective enclosure according to an embodiment of the invention.

In aspects, one or both side walls 22 and 24 may have a door 44 and 46 to allow a person to enter the interior space of building 16. As shown in FIGS. 10 and 11, in aspects, steps may be provided at one or both doors. In aspects, an exterior step 48 and/or an interior step 50 can be provided for door 44. In aspects, an exterior step 52 and/or an interior step 54 can be provided for door 46. In aspects, these steps may be pivotally attached to their respective walls for movement between raised, stowed positions, and lowered, in use positions.

Figure 7:
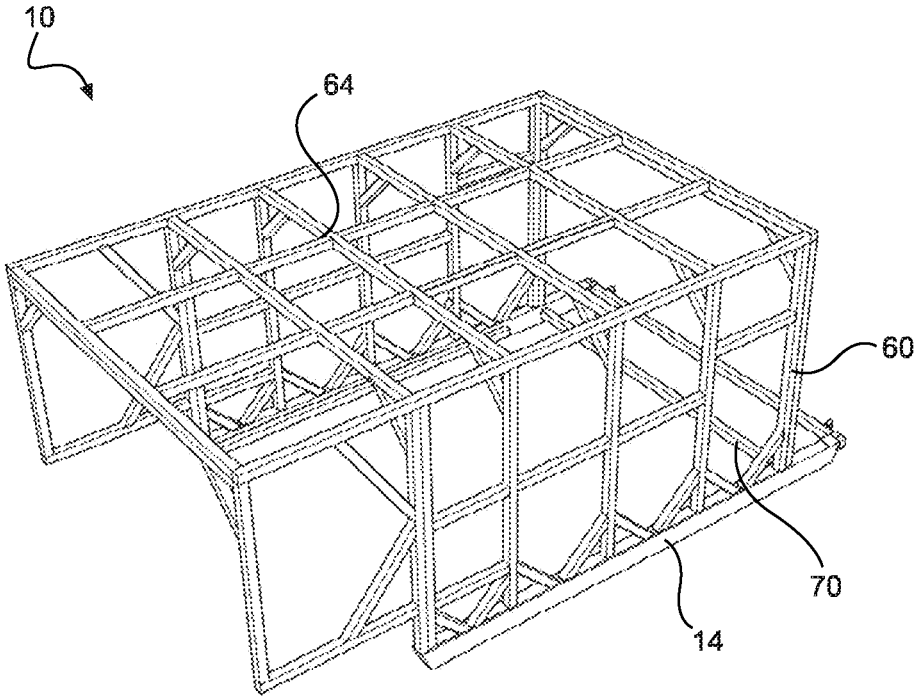
FIG. 7 is a perspective view of a frame structure of a portable protective enclosure according to an embodiment of the invention.
Figure 8:
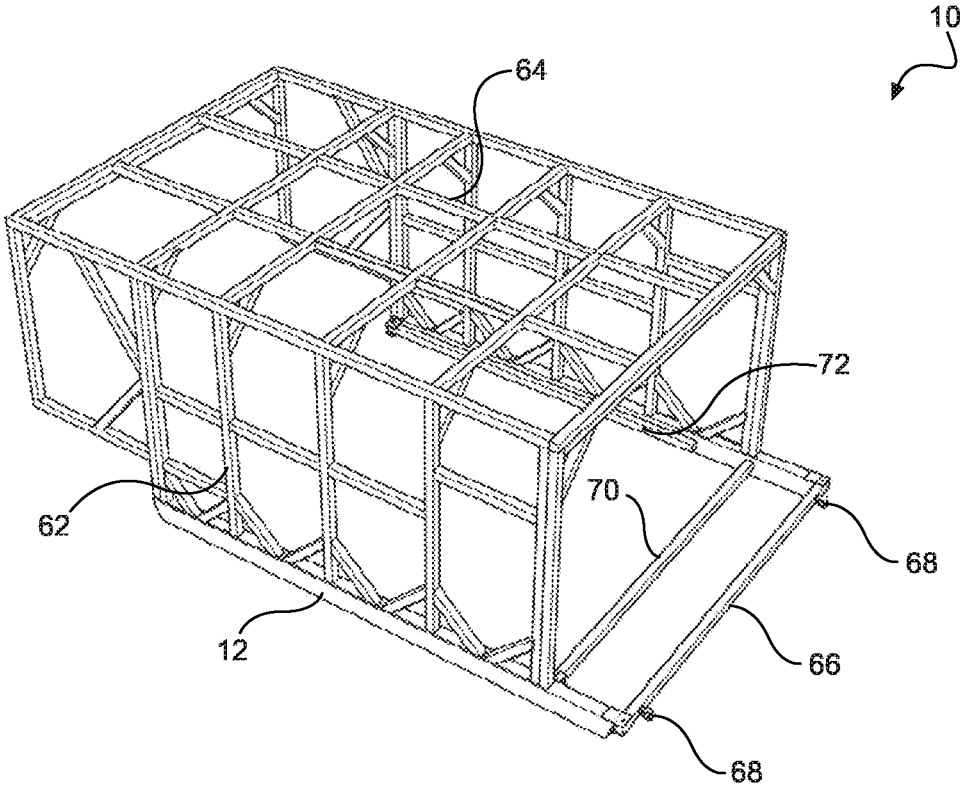
FIG. 8 is a second perspective view of a frame structure of a portable protective enclosure according to an embodiment of the invention.
Figure 9:
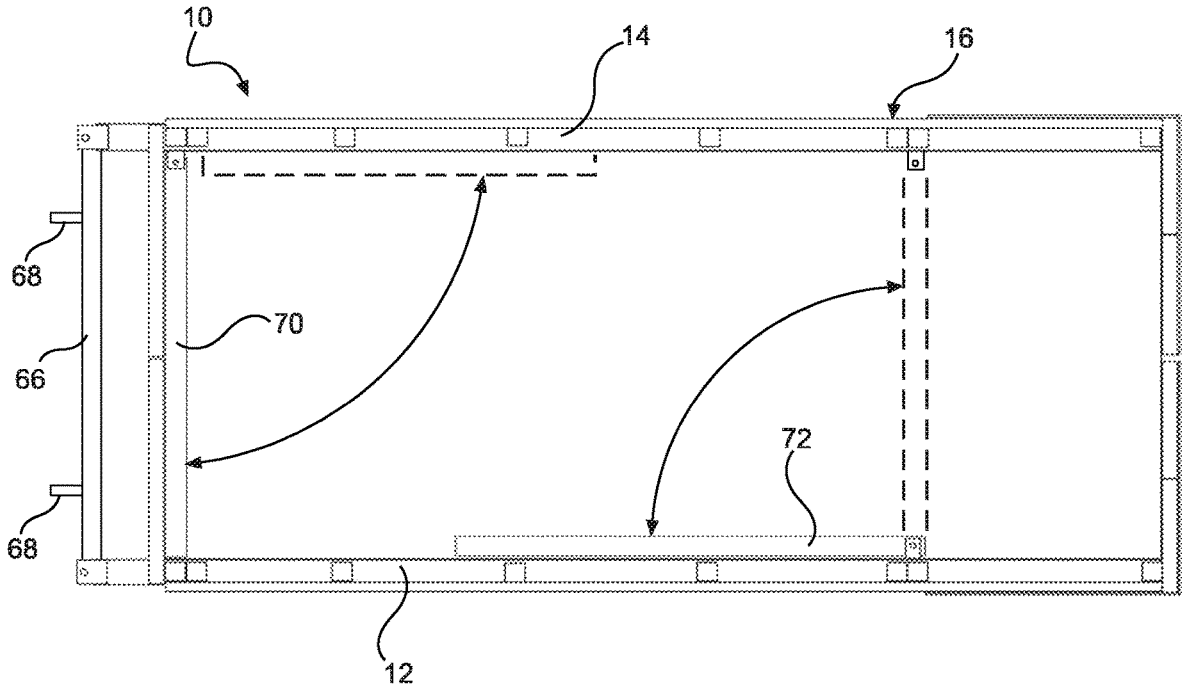
FIG. 9 is a top, cross-sectional view of a frame structure of a portable protective enclosure according to an embodiment of the invention taken along line 9-9 in FIG. 7.

With further reference to FIGS. 7-9, building 16 may have a frame structure that is supported on the skids 12 and 14. As shown, the frame structure may have wall frames 60 and 62 and a roof frame 64. As in conventional framing, the wall frames may have a plurality of spaced vertical frame members (studs) extending between horizontal frame members (footers and headers). Similarly, the roof frame may have a plurality spaced of joists.

In aspects, a tow beam 66 may be provided which extends between the skids 12 at the first ends of the skids. The tow beam may be removably attached at its opposite ends to the skids by a coupling located on each skid. The coupling may have a receiver for receiving the end of the tow bar and a removable bolt that extends through the receiver and the end of the tow bar. Tow eyes 68 may be attached to the tow beam 66 for coupling with a tow vehicle for towing the enclosure over the ground.

In aspects, cross members, representatively two cross members 70 and 72 may be attached to the skids 12 and 14 to increase its rigidity during towing. Each cross member 70 and 72 may be pivotally attached at one end to one skid for rotation within the space between the skids and between a first, extended position wherein the cross members extend between the skids and a second, rotated stored position wherein the cross members extend along a length of a skid. In the first position, the end of each cross member opposite the pivot attachment is removably secured to the opposite skid by a coupling. The coupling may have a receiver for receiving the end of a cross member and a removable bolt that extends through the receiver and the end of the cross member.

As representatively shown, cross member 70 is pivotally attached at one end to skid 12 for rotation with the opposite end being removably connectable to skid 14 by the coupling. And cross member 72 is pivotally attached at one end to skid 14 for rotation with the opposite end being removably connectable to skid 12 by the coupling. When the cross members 70 and 72 are in the extend positions and are attached at both ends to the skids 12 and 14, the cross members provide rigidity to the structure. When in the rotated, stowed position the space between the skids 12 and 14 is unobstructed by the cross members, thus allowing the enclosure to be moved over equipment with the equipment disposed between the skids.

In use, enclosure 10 is prepared to be towed to the service location by configuring the enclosure by securing the tow beam 66 at its ends to the skids 12 and 14 with the tow beam extending between the skids, securing the swing doors 28-32 in the closed position by respective latches, securing the access panels, 36*a*-36*b*, 38*a*-38*d*, 40*a*-40*b*, and 42*a*-42*b*, in the raised, opened position by respective latches, securing steps 48-54 in the raised, stowed position by respective latches, and securing each cross members 70 and 72 in its extended position with its ends secured to the skids.

In the ready-tow configuration, an equipment operator would drive an appropriate size of equipment, such as a loader, to the enclosure and couple the loader to the tow beam 66 for towing by the loader by securing a tow sling to the tow eyelets 68. The operator would use the loader to tow the enclosure to the end use location.

Once the enclosure is towed to the end use location, the operator would unhook the tow slings and position the forks of the loader on the underside of the tow beam 66. The operator would use the forks on the loader to maneuver the enclosure in front of the critical piece of equipment that is already fully set up, functioning and in place with the backside (the side opposite of the tow beam) of the enclosure closest to the critical piece of equipment such as a pump. Once the enclosure is in position, the swing doors 28-32 are opened and secured in the open position by respective latches. With the swing doors open, the operator has a clear view through the enclosure while sitting in the loader. The cross members 70 and 72 are disconnected at their respective connection ends to the skids 12 and 14 and are rotated into the second position with the cross members laying generally parallel along a respective skid.

In this configuration, the interior of the building and the space between the skids are completely open with no obstructions as the building has no floor. The operator then, using the loader, pushes the entire enclosure over the top of the critical piece of equipment, such as a pump, for example. Once the enclosure is positioned over the equipment, the enclosure may be configured to a use configuration.

Figure 12:
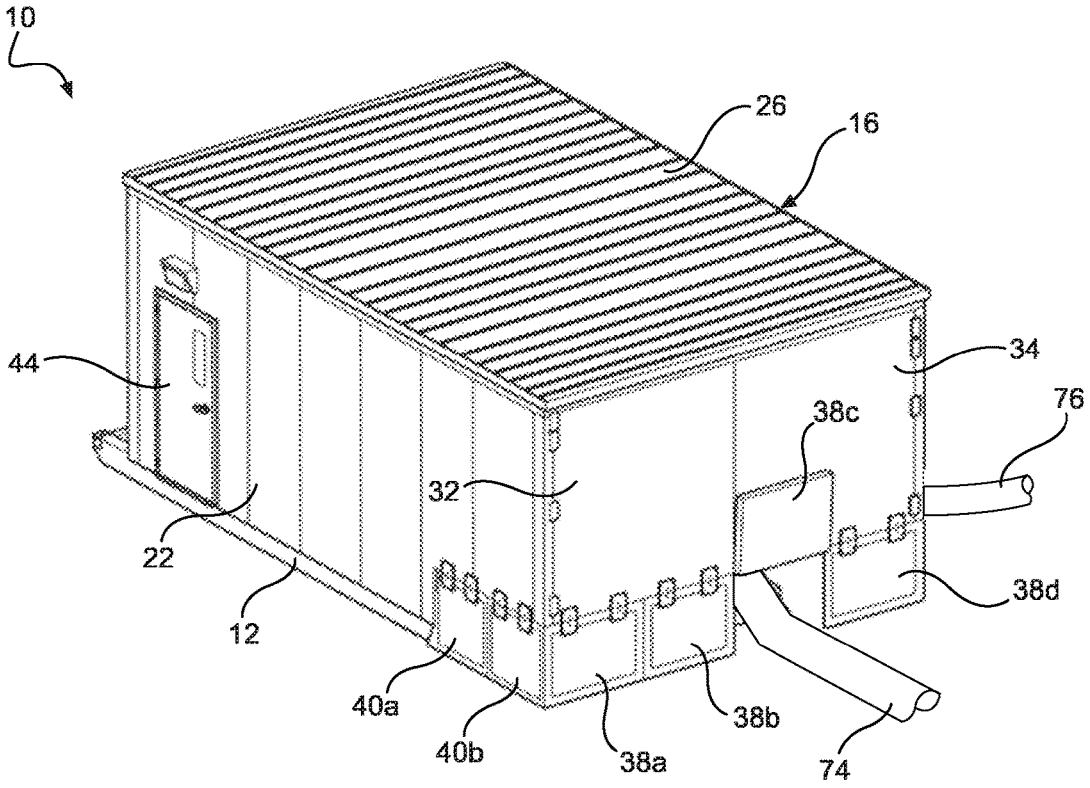
FIG. 12 is a perspective view of a portable protective enclosure according to an embodiment of the invention, showing the enclosure in use with a pump.
Figure 13:
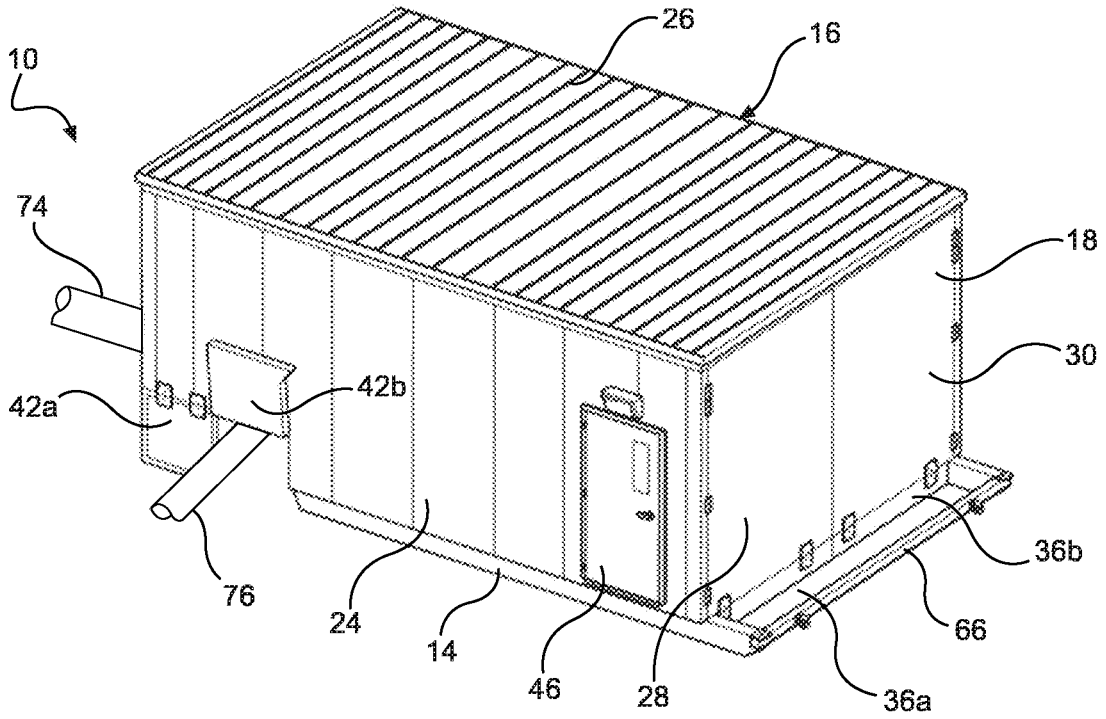
FIG. 13 is a second perspective view of a portable protective enclosure according to an embodiment of the invention, showing the enclosure in use with a pump.
Figure 14:
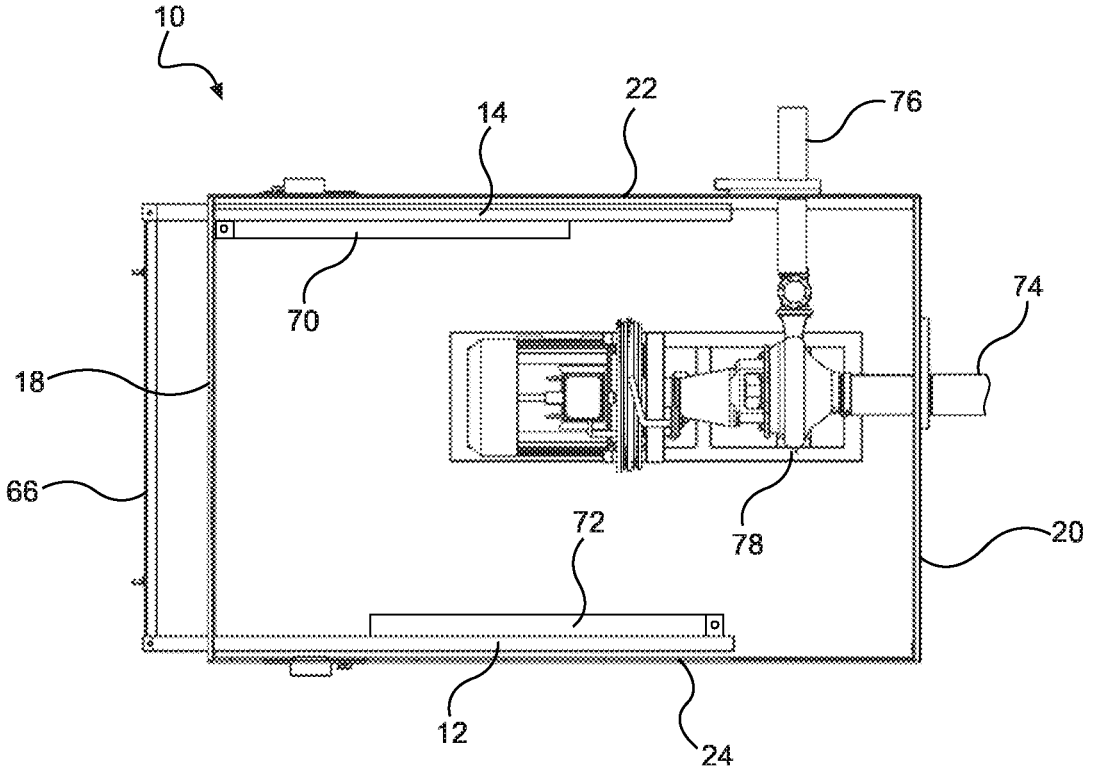
FIG. 14 is a top, cross-sectional view of a portable protective enclosure according to an embodiment of the invention taken along line 14-14 in FIG. 12.

In a use configuration, as best seen in FIGS. 12-14, the steps 48-54 are lowered (not shown here), the swing doors 28-32 are closed and secured in the closed position by respective latches and access panels 36*a*-36*b* are lowered into the seal position. Access panels 38*a*-38*d*, 40*a*-40*b*, and 42*a*-42*b* are lowered into the seal position except where equipment components, such as suction and discharge lines 74 and 76 of the pump 78 are located. Only the access panels where these lines are located remain in the open position. If necessary, insulated tarping to fill any gaps remaining around the suction line 74 and discharge line 76. The tow beam 66 may also be disconnected by from the skids 12 and 14 and could be taken back to the lay down yard as the same beam can be used for other enclosures 10.

The operator would then plug in the lighting circuits and heaters into a mobile power source such as a power generator (not shown). The critical piece of equipment, such as pump 78, is now fully enclosed and protected by enclosure from the harsh cold winters experienced in the northern hemispheres. The critical piece of equipment will not freeze up inside enclosure 10 that may also a fully electrified enclosure including lights and heaters. When an end user needs to relocate enclosure 10, the operator would just do the steps above in reverse order and tow the enclosure away to the next desired location.

Figure 15:
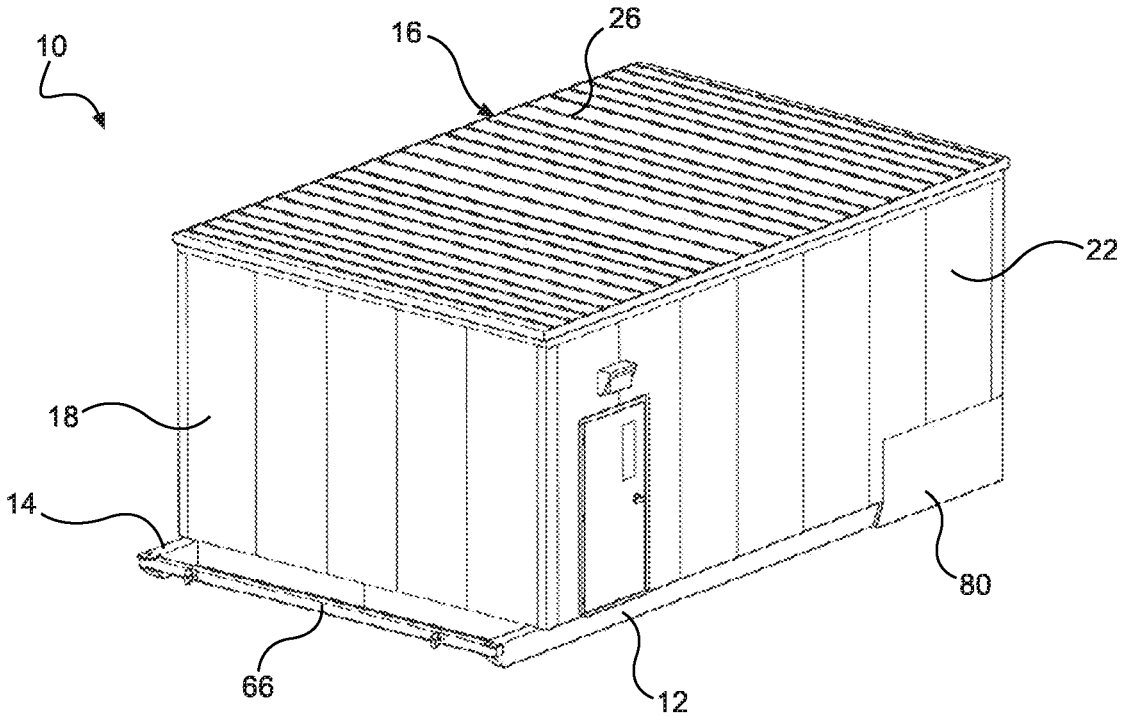
FIG. 15 is a perspective view of a portable protective enclosure according to an embodiment of the invention.
Figure 16:
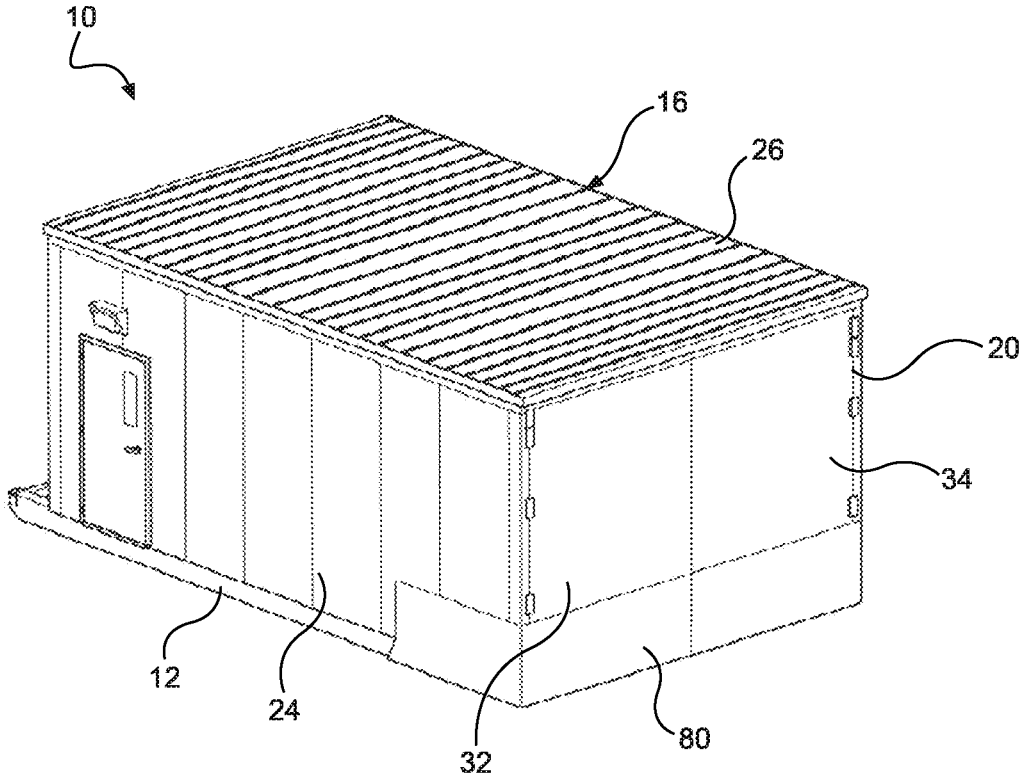
FIG. 16 is a second perspective view of the portable protective enclosure according to an embodiment of the invention.
Figure 17:
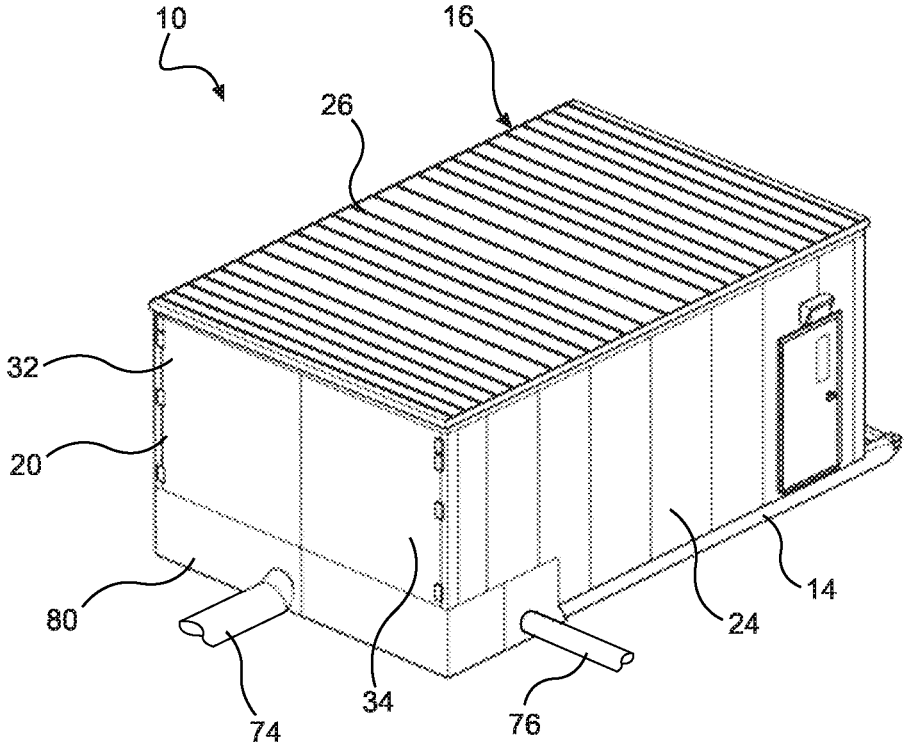
FIG. 17 is a perspective view of a portable protective enclosure according to an embodiment of the invention, showing the enclosure in use with a pump.

Enclosure 10 may have alternative configurations. For example, in FIGS. 15-17, enclosure 10 is shown in one possible alternative configuration. In this configuration, end wall 18 does not have swing doors 28 and 30 and access panels 36*a* and 36*b*. Further, as shown, one or more access panels 38*a*-38*d*, 40*a*-40*b*, and 42*a*-42*b*, may be replaced by a skirt 80, representatively shown here with all these panels replaced by the skirt. The skirt 80 may be a flexible rubber material.

Figure 18:
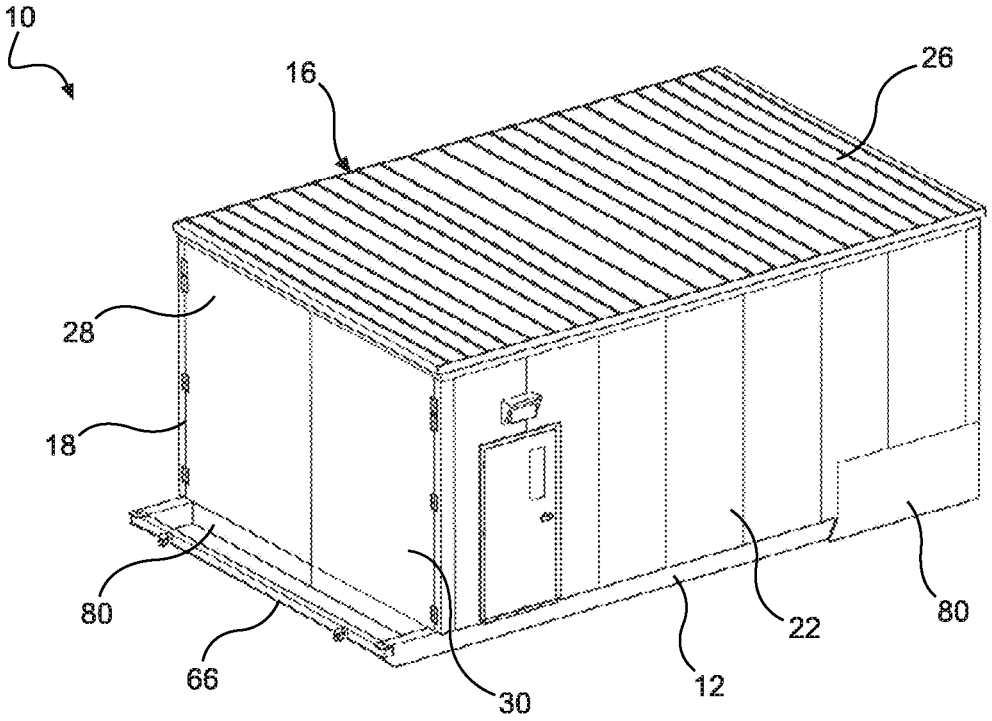
FIG. 18 is a perspective view of a portable protective enclosure according to an embodiment of the invention.
Figure 19:
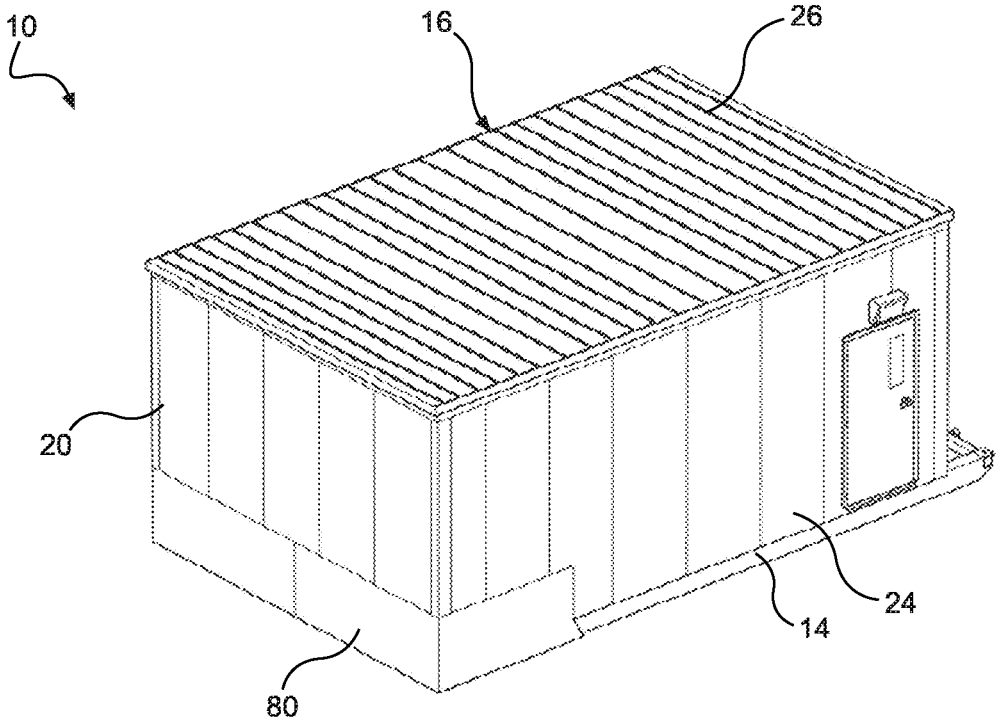
FIG. 19 is a second perspective view of the portable protective enclosure according to an embodiment of the invention.
Figure 20:
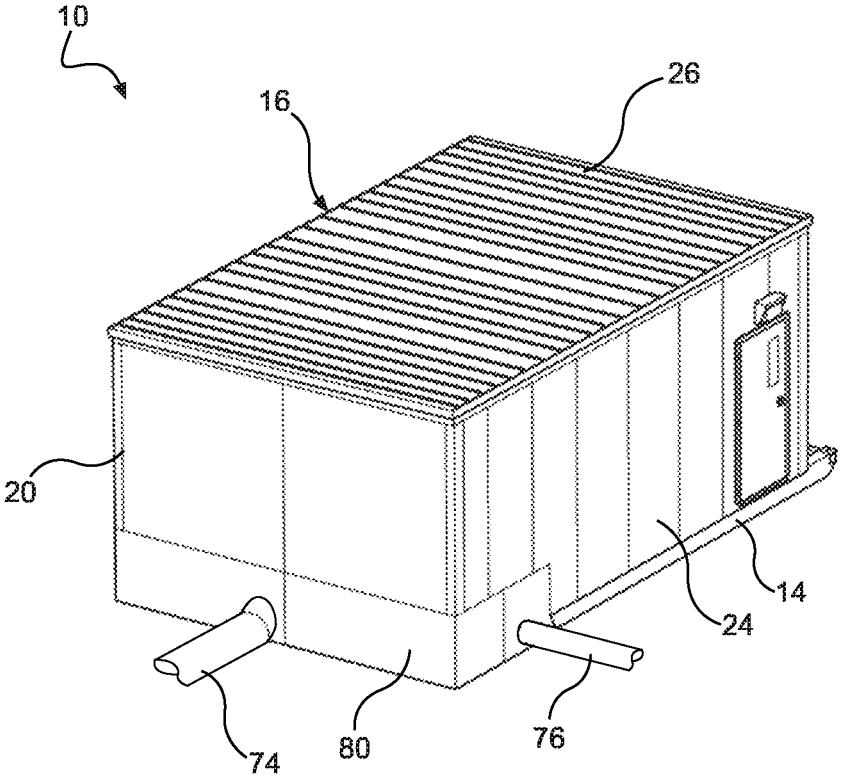
FIG. 20 is a perspective view of a portable protective enclosure according to an embodiment of the invention, showing the enclosure in use with a pump.

In FIGS. 18-20, enclosure 10 is shown in another possible configuration. In this configuration, end wall 20 does not have swing doors 32 and 34. Further shown, access panels 38*a*-38*d*, 40*a*-40*b*, and 42*a*-42*b* are replaced by skirt 80.

It is important to note that the foregoing described enclosure 10 configurations are examples and are not mutually exclusive. For example, in any configuration one or more access panels 38*a*-38*d*, 40*a*-40*b*, and 42*a*-42*b* may be provided and/or one or more access panels may be replaced by a skirt 80.

While the disclosure has been illustrated and described in detail in the drawings and foregoing description, unless otherwise stated such illustration and description are to be considered exemplary and not restrictive in character, it being understood that illustrative embodiments have been shown and described and that all changes and modifications that come within the spirit of the disclosure are desired to be protected. It will be noted that alternative embodiments of the present disclosure may not include all the features described yet still benefit from at least some of the advantages of such features. Those of ordinary skill in the art may readily devise their own implementations that incorporate one or more of the features of the present disclosure and fall within the spirit and scope of the present invention as defined by the appended claims.

What is claimed is:

1. A portable protective enclosure comprising:

first and second skids being arranged parallel and spaced to one another defining a space therebetween, the first and second skids having a first end and an opposite second end;

a building supported on the skids for movement therewith, the building comprising first and second end walls each extending across the skids, first and second side walls one each extending along a length of a respective skid, and a roof spanning the first and second end walls and the first and second side walls, the building being free of a floor; and a first cross member pivotally attached at one end to the first skid for rotation within the space between the first and second skids between a first position wherein the first cross member extends between the skids and a second position wherein the first cross member extends along a length of the first skid, the opposite end of the first cross member being detachably secured to the second skid when in the first position.

2. The portable protective enclosure of claim 1, wherein:

the first end wall comprising a pair of first swing doors that are openable to permit access to an interior of the building and to the space between the first and second skids; and the second end wall comprising a pair of second swing doors that are openable to permit access to an interior of the building and to the space between the first and second skids.

3. The portable protective enclosure of claim 2, wherein:

each swing door of the pair of first swing doors has a forward access panel located at a bottom of the door and extending along a width of the door, wherein the forward access panel is an insulated panel or is a strip of flexible rubber material; and each swing door of the pair of second swing doors having two side-by-side rearward access panels located at a bottom of the door and extending along a width of the door, wherein the rearward access panels are insulated panels or a strip of flexible rubber material.

4. The portable protective enclosure of claim 1, wherein:

the first end wall comprising a pair of first swing doors that are openable to permit access to an interior of the building and to the space between the first and second skids.

5. The portable protective enclosure of claim 4, wherein:

each swing door of the pair of first swing doors has a forward access panel located at a bottom of the door and extending along a width of the door, wherein the forward access panel is an insulated panel or is a strip of flexible rubber material.

6. The portable protective enclosure of claim 1, wherein:

the second end wall comprising a pair of second swing doors that are openable to permit access to an interior of the building and to the space between the first and second skids.

7. The portable protective enclosure of claim 6, wherein:

each swing door of the pair of second swing doors having two side-by-side rearward access panels located at a bottom of the door and extending along a width of the door, wherein the rearward access panels are insulated panels or a strip of flexible rubber material.

8. The portable protective enclosure of claim 1, further comprising:

a tow beam extending between the first and second skids at the first ends thereof, the tow beam being removably attached at its opposite ends to the first and second skids; and two tow eyes attached to the tow beam and configured to be connected to a tow vehicle for towing the skids and attached building.

9. The portable protective enclosure of claim 1, further comprising:

a second cross member pivotally attached at one end to the second skid for rotation within the space between the first and second skids between a first position wherein the second cross member extends between the skids and a second position wherein the second cross member extends along a length of the second skid, the opposite end of the second cross member being detachably secured to the first skid when in the first position.

10. The portable protective enclosure of claim 1, further comprising:

the first side wall having a pair of first side access panels disposed at a bottom end of the first side wall proximate the second end wall, wherein the first side access panels are insulated panels or a strip of flexible rubber material; and the second side wall having a pair of second side access panels disposed at a bottom end of the second side wall proximate the second end wall, wherein the first side access panels are insulated panels or a strip of flexible rubber material.

11. The portable protective enclosure of claim 1, further comprising:

one or more doors in one or both of the first and second side walls.

12. The portable protective enclosure of claim 11, further comprising:

one or more steps attached to one or both of the first and second side walls.

13. A portable protective enclosure comprising:

first and second skids being arranged parallel and spaced to one another defining a space therebetween, the first and second skids having a first end and an opposite second end;

a building supported on the skids for movement therewith, the building comprising first and second end walls each extending across the skids, first and second side walls one each extending along a length of a respective skid, and a roof spanning the first and second end walls and the first and second side walls, the building being free of a floor, the first and second end walls, the first and second side walls, and the roof being insulated;

the first end wall comprising a pair of first swing doors that are openable to permit access to an interior of the building and to the space between the first and second skids;

the second end wall comprising a pair of second swing doors that are openable to permit access to an interior of the building and to the space between the first and second skids;

a tow beam extending between the first and second skids at the first ends thereof, the two beam being removably attached at its opposite ends to the first and second skids;

two tow eyes attached to the tow beam and configured to be connected to a tow vehicle for towing the skids and attached building;

each swing door of the pair of first swing doors has a forward access panel located at a bottom of the door and extending along a width of the door, wherein the forward access panel is insulated panel or is a strip of flexible rubber material;

each swing door of the pair of second swing doors having two side-by-side rearward access panels located at a bottom of the door and extending along a width of the door, wherein the rearward access panels are insulated panels or a strip of flexible rubber material;

the first side wall having a pair of first side access panels disposed at a bottom end of the first side wall approximate the second end wall, wherein the first side access panels are insulated panels or a strip of flexible rubber material;

the second side wall having a pair of second side access panels disposed at a bottom end of the second side wall approximate the second end wall, wherein the first side access panels are insulated panels or a strip of flexible rubber material; and a first cross member pivotally attached at one end to the first skid for rotation within the space between the first and second skids between a first position wherein the first cross member extends between the skids and a second position wherein the first cross member extends along a length of the first skid, the opposite end of the first cross member being detachably secured to the second skid when in the first position.

14. The portable protective enclosure of claim 13, further comprising:

a second cross member pivotally attached at one end to the second skid for rotation within the space between the first and second skids between a first position wherein the second cross member extends between the skids and a second position wherein the second cross member extends along a length of the second skid, the opposite end of the second cross member being detachably secured to the first skid when in the first position.

15. The portable protective enclosure of claim 13, further comprising:

the first side wall having a first door;

the second side wall having a second door;

a first access step pivotally attached to the first side wall on an exterior surface thereof and at a location below the first door;

a second access step pivotally attached to the first side wall on an interior surface thereof and at a location below the first door;

a third access step pivotally attached to the second side wall on an exterior surface thereof and at a location below the second door; and a fourth access step pivotally attached to the second side wall on an interior surface thereof and at a location below the second door.

16. A portable protective enclosure comprising:

first and second skids being arranged parallel and spaced to one another defining a space therebetween, the first and second skids having a first end and an opposite second end;

a building supported on the skids for movement therewith, the building comprising first and second end walls each extending across the skids, first and second side walls one each extending along a length of a respective skid, and a roof spanning the first and second end walls and the first and second side walls, the building being free of a floor, the first and second end walls, the first and second side walls, and the roof being insulated;

the first end wall comprising a pair of first swing doors that are openable to permit access to an interior of the building and to the space between the first and second skids;

the second end wall comprising a pair of second swing doors that are openable to permit access to an interior of the building and to the space between the first and second skids;

a tow beam extending between the first and second skids at the first ends thereof, the two beam being removably attached at its opposite ends to the first and second skids;

two tow eyes attached to the tow beam and configured to be connected to a tow vehicle for towing the skids and attached building;

a first cross member pivotally attached at one end to the first skid for rotation within the space between the first and second skids between a first position wherein the first cross member extends between the skids and a second position wherein the first cross member extends along a length of the first skid, the opposite end of the first cross member being detachably secured to the second skid when in the first position;

a second cross member pivotally attached at one end to the second skid for rotation within the space between the first and second skids between a first position wherein the second cross member extends between the skids and a second position wherein the second cross member extends along a length of the second skid, the opposite end of the second cross member being detachably secured to the first skid when in the first position;

each swing door of the pair of first swing doors has a forward access panel located at a bottom of the door and extending along a width of the door, wherein the forward access panel is insulated panel or is a strip of flexible rubber material;

each swing door of the pair of second swing doors having two side-by-side rearward access panels located at a bottom of the door and extending along a width of the door, wherein the rearward access panels are insulated panels or a strip of flexible rubber material;

the first side wall having a pair of first side access panels disposed at a bottom end of the first side wall approximate the second end wall, wherein the first side access panels are insulated panels or a strip of flexible rubber material;

the second side wall having a pair of second side access panels disposed at a bottom end of the second side wall approximate the second end wall, wherein the first side access panels are insulated panels or a strip of flexible rubber material;

the first side wall having a first door;

the second side wall having a second door;

a first access step pivotally attached to the first side wall on an exterior surface thereof and at a location below the first door;

a second access step pivotally attached to the first side wall on an interior surface thereof and at a location below the first door;

a third access step pivotally attached to the second side wall on an exterior surface thereof and at a location below the second door; and a fourth access step pivotally attached to the second side wall on an interior surface thereof and at a location below the second door.

* * * * *